US010637193B2

(12) United States Patent
Furugoori

(10) Patent No.: US 10,637,193 B2
(45) Date of Patent: Apr. 28, 2020

(54) POWER SUPPLY CIRCUIT DISCONNECTION DEVICE

(71) Applicant: Yazaki Corporation, Minato-ku, Tokyo (JP)

(72) Inventor: Osamu Furugoori, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/445,834

(22) Filed: Jun. 19, 2019

(65) Prior Publication Data

US 2019/0386430 A1 Dec. 19, 2019

(30) Foreign Application Priority Data

Jun. 19, 2018 (JP) ..... 2018-116169

(51) Int. Cl.
*H01R 13/627* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/6298; H01R 13/62955
USPC ..... 157/157, 924, 2
See application file for complete search history.

(56) References Cited

U.S. PATENT DOCUMENTS 6,982,393 B2 * 1/2006 Matsui ..... H01R 13/62933 200/335
7,287,993 B2 * 10/2007 Fujii ..... H01R 13/62938 439/157
7,445,491 B2 * 11/2008 Fujii ..... H01R 13/62938 439/157
7,500,865 B2 * 3/2009 Natter ..... H01R 27/02 439/362
7,872,206 B2 * 1/2011 Matsunaga ..... H01H 9/085 200/335
8,696,373 B2 * 4/2014 Yagome ..... H01R 13/62955 439/310
8,734,170 B2 * 5/2014 Ikeda ..... H01R 13/62955 439/157
8,911,245 B2 * 12/2014 Okamoto ..... H01R 13/62944 439/157

(Continued)

FOREIGN PATENT DOCUMENTS

JP 2013-062043 A 4/2013

*Primary Examiner* — Neil Abrams
(74) *Attorney, Agent, or Firm* — Banner & Witcoff, Ltd.

(57) ABSTRACT

A power supply circuit disconnection device includes a lever configured to be rotated between a separating operation position and a final fitting operation position to bring a first connector housing and a second connector housing into a separable state and a finally fitted state, a sub-lock unit configured to lock the lever at the temporary fitting operation position, a main switch unit for power lines configured to be switched on in the finally fitted state and the temporarily fitted state and switched off in the separable state, a sub-switch unit for signal lines configured to be switched on in the finally fitted state and switched off in the temporarily fitted state and the separable state, and a lock releasing portion configured to release lock of the lever by the sub-lock unit, the lock releasing portion being covered and not exposed to outside in the finally fitted state.

4 Claims, 7 Drawing Sheets

(56) References Cited

U.S. PATENT DOCUMENTS

| | | | | |
|---|---|---|---|---|
| 8,986,024 | B2 * | 3/2015 | Ikeda | H01H 9/102 439/157 |
| 9,130,324 | B2 * | 9/2015 | Furuya | H01R 24/005 |
| 9,397,459 | B2 * | 7/2016 | Butcher | H01R 33/95 |
| 9,716,341 | B2 * | 7/2017 | Yamane | H01R 13/703 |
| 9,871,322 | B2 * | 1/2018 | Kanda | H01R 13/62955 |
| 10,297,945 | B2 * | 5/2019 | Yamane | H01R 13/6295 |
| 10,431,933 | B2 * | 10/2019 | Gibeau | H01R 13/465 |
| 2013/0065412 | A1 | 3/2013 | Ikeda et al. | |
| 2019/0386430 | A1 * | 12/2019 | Furugoori | H01R 13/62955 |

* cited by examiner

POWER SUPPLY CIRCUIT DISCONNECTION DEVICE

CROSS REFERENCE TO RELATED APPLICATIONS

This application is based on Japanese Patent Application (No. 2018-116169) filed on Jun. 19, 2018, the contents of which are incorporated herein by reference.

BACKGROUND OF THE INVENTION

1. Field of the Invention

The present invention relates to a power supply circuit disconnection device.

2. Description of the Related Art

For example, a vehicle such as an electric vehicle or a hybrid vehicle is provided with a power supply circuit disconnection device called a service plug configured to disconnect energization between a power supply unit and a load for the purpose of ensuring operation safety in maintenance of an electrical system thereof. In such a power supply circuit disconnection device, there is a device configured to provide a time lag between on and off of a power supply circuit switch and a signal circuit switch and prevent the generation of sparks and arcs resulting from remaining current after the signal circuit switch is switched off (see JP-A-2013-62043).

The related connector described in JP-A-2013-62043 has a sub-lock unit configured to switch off a signal circuit switch before a power supply circuit switch is switched off by engaging a lever, which is operated to rotate when attaching and detaching the housings, in the middle of the rotation.

However, a lock releasing portion provided on the lever and configured to release the lock by the sub-lock unit is usually exposed to the outside in the connector. Therefore, when rotating the lever to separate the housings, the lever may be rotated while operating the lock releasing portion exposed to the outside, and a sufficient time lag may not be secured for switching on and off the power supply circuit switch and the signal circuit switch.

SUMMARY OF THE INVENTION

The present invention is made in view of the above circumstances, and an object thereof is to provide a power supply circuit disconnection device in which a time lag between on and off of a main switch unit and a sub-switch unit is reliably ensured, and the occurrence of sparks, arcs or the like resulting from an remaining current after the sub-switch unit is switched off can be favorably prevented.

In order to achieve the above-described object, a power supply circuit disconnection device according to the present invention is characterized in the following (1) to (4).

(1) A power supply circuit disconnection device including:

a first connector housing;

a second connector housing configured to be fitted to and separated from the first connector housing;

a lever rotatably supported on the second connector housing and configured to, by being rotated between a separating operation position and a final fitting operation position, bring the first connector housing and the second connector housing into a separable state of being separable from each other and a finally fitted state of being completely fitted with each other;

a sub-lock unit configured to lock the lever to the second connector housing in a temporarily fitted state in which the lever is disposed at a temporary fitting operation position between the final fitting operation position and the separating operation position and a part of the second connector housing is fitted to the first connector housing;

a main switch unit configured to be switched on in the finally fitted state and the temporarily fitted state, and switched off in the separable state;

a sub-switch unit configured to be switched on in the finally fitted state, and switched off in the temporarily fitted state and the separable state; and a lock releasing portion provided on the lever and configured to release lock of the lever by the sub-lock unit, wherein the lock releasing portion is covered and not exposed to outside in the finally fitted state.

(2) The power supply circuit disconnection device according to (1), wherein the lock releasing portion is provided on a front side of the lever in a rotation direction toward the final fitting operation position of the lever, and wherein the first connector housing has an accommodating portion in which the lock releasing portion is accommodated when the lever is disposed at the final fitting operation position.

(3) The power supply circuit disconnection device according to (1) or (2), wherein the lever includes a pair of arm portions one ends of which are rotatably supported on side surfaces of the second connector housing, and a connection portion which connects the other ends of the pair of arm portions;

wherein the sub-lock unit includes a sub-lock claw provided on the second connector housing, and an engaging claw provided on the connection portion configured to engage with the sub-lock claw at the temporary fitting operation position, and configured to be separated from the sub-lock claw by pressing the lock releasing portion; and wherein the lock releasing portion is:

provided on a second connector housing side on the connection portion, disposed at a position opposite and close to another side surface of the second connector housing when the lever is disposed at the final fitting operation position, and disposed on an upper surface side of the second connector housing when the lever is disposed at the temporary fitting operation position.

(4) The power supply circuit disconnection device according to any one of (1) to (3), further including:

a main lock unit configured to lock the lever disposed at the final fitting operation position to the second connector housing.

According to the power supply circuit disconnection device configured as (1), when the lever at the final fitting operation position is rotated toward the separating operation position, the lever is locked by the sub-lock unit at the temporary fitting operation position and is restricted in rotation. Therefore, after the sub-switch unit is switched off, the main switch unit cannot be switched off unless the lock by the sub-lock unit is released and the lever at the temporary fitting operation position is rotated to the separating operation position. Therefore, the occurrence of arcs, sparks or the like resulting from remaining current generated by the main switch unit being switched off immediately after the sub-switch unit being switched off is prevented.

In the power supply circuit disconnection device according to the present invention, the lock releasing portion configured to release the lock by the sub-lock unit is covered and not exposed to outside in the finally fitted state. Therefore, the lever in the final fitting operation position can be rotated without operating the lock releasing portion, so that the rotation of the lever can be reliably restricted at the temporary fitting operation position by the sub-lock unit. Accordingly, the time lag between on and off of the main switch unit and the sub-switch unit is reliably ensured, and the occurrence of sparks, arcs or the like resulting from an remaining current after the sub-switch unit is switched off can be favorably prevented.

According to the power supply circuit disconnection device configured as (2), the lock releasing portion can be easily accommodated in the accommodating portion provided in the first connector housing when the lever is rotated to dispose at the final fitting operation position. Further, since the lock releasing portion is accommodated in the accommodating portion, the contact with the lock releasing portion in the finally fitted state can be further prevented reliably, and the time lag between on and off of the main switch unit and the sub-switch unit is further ensured reliably.

According to the power supply circuit disconnection device configured as (3), the lock releasing portion is disposed at a position opposite and close to a side surface of the second connector housing by the lever being disposed at the final fitting operation position, so that the contact with the lock releasing portion in the finally fitted state can be further prevented reliably. Further, the lock releasing portion is disposed on an upper surface side of the second connector housing by the lever being disposed at the temporary fitting operation position, so that the lock releasing portion can be pressed in the temporarily fitted state to separate the engaging claws from the sub-lock claws and release the lock easily.

According to the power supply circuit disconnection device configured as (4), careless rotation of the lever is restricted since the main lock unit is provided, so that the finally fitted state can be maintained in which the first connector housing 10 and the second connector housing 20 are completely fitted with each other.

Effect of Invention

According to the present invention, it is possible to provide a power supply circuit disconnection device in which a time lag between on and off of a main switch unit and a sub-switch unit is reliably ensured, and the occurrence of sparks, arcs or the like resulting from an remaining current after the sub-switch unit is switched off can be favorably prevented.

The present invention has been briefly described as above. Further, details of the present invention will be clarified by reading a mode (hereinafter, referred to as "embodiment".) for carrying out the invention described below with reference to attached drawings.

BRIEF DESCRIPTION OF THE DRAWINGS

FIGS. 5A and 5B are views showing an internal structure of power supply circuit disconnection device, in which FIG. 5A is a cross-sectional view taken along a width direction of the power supply circuit disconnection device, and FIG. 5B is a partial cross-sectional view taken along a length direction of the power supply circuit disconnection device.

FIGS. 6A and 6B are views showing a lock mechanism of a lever, in which FIG. 6A is a partial cross-sectional view taken along the width direction of the power supply circuit disconnection device in the finally fitted state showing a main lock unit, and FIG. 6B is a side view of the power supply circuit disconnection device in the temporarily fitted state in which the lever is viewed in cross section.

DETAILED DESCRIPTION OF THE EXEMPLARY EMBODIMENTS

Hereinafter, an embodiment according to the present invention will be described with reference to the drawings.

Figure 1:
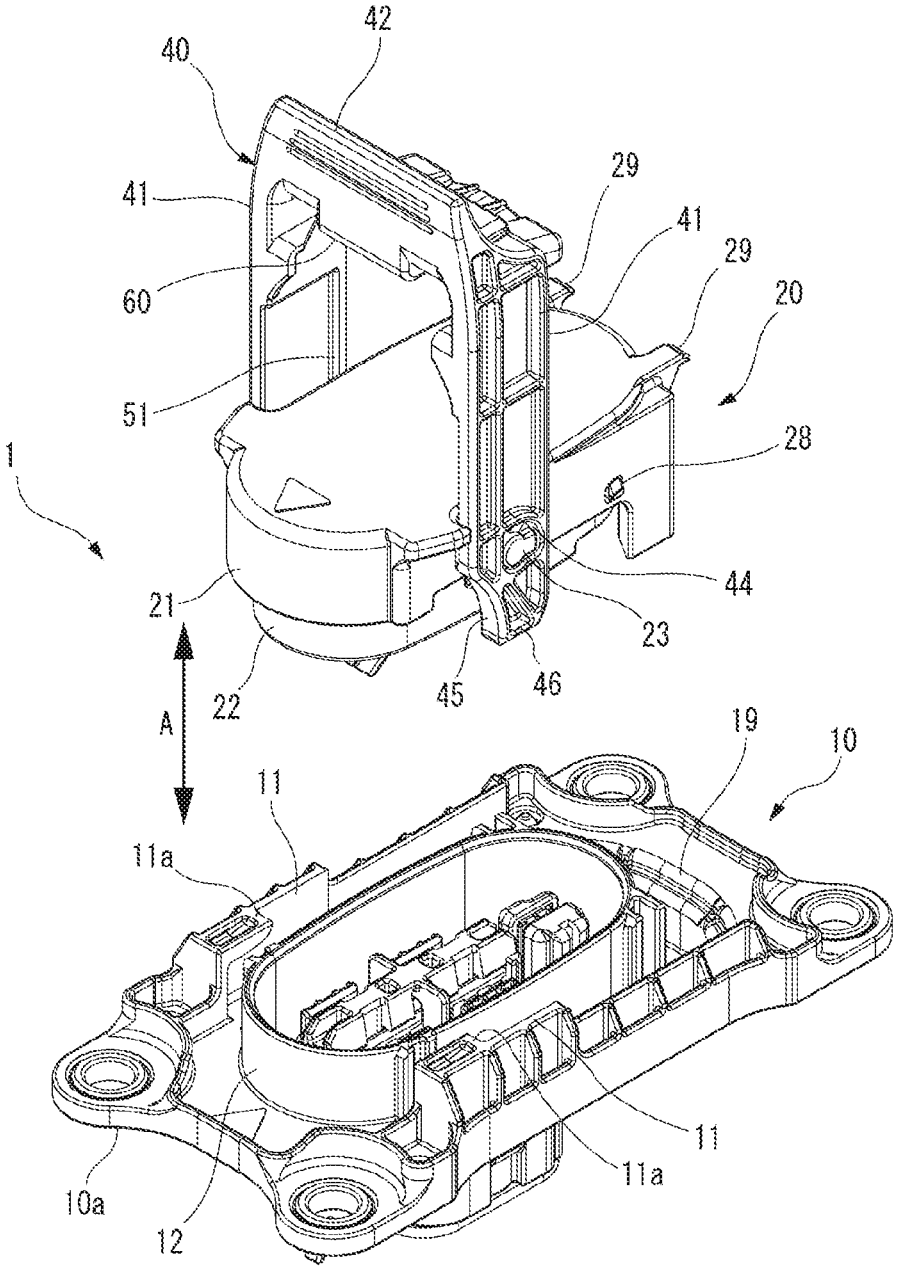
FIG. 1 is a perspective view of a first connector housing and a second connector housing of a power supply circuit disconnection device according to the present embodiment.
Figure 2:
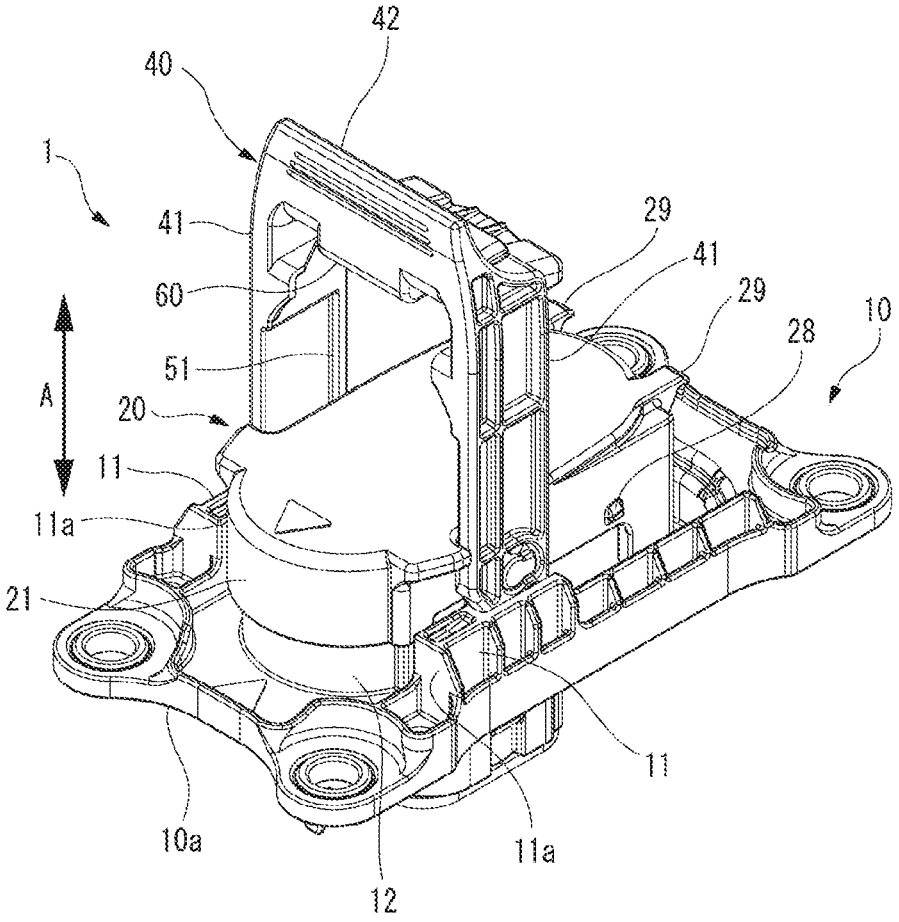
FIG. 2 is a perspective view of the power supply circuit disconnection device in which the first connector housing and the second connector housing are in an attaching or detaching state.
Figure 3:
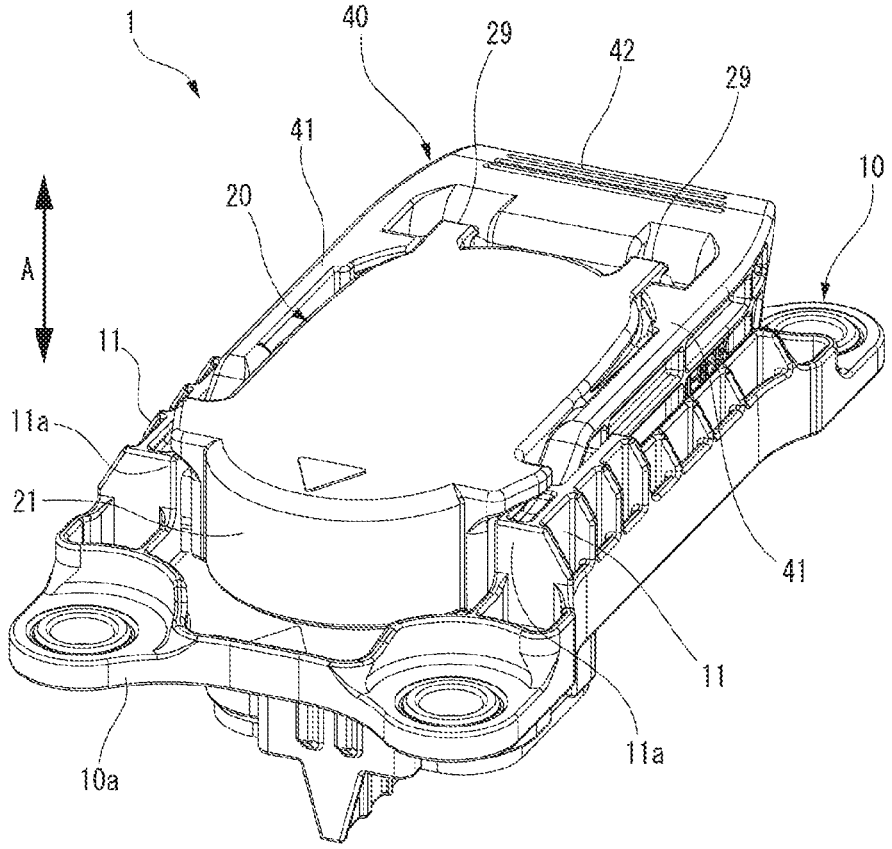
FIG. 3 is a perspective view of the power supply circuit disconnection device in which the first connector housing and the second connector housing are in a finally fitted state.
Figure 4:
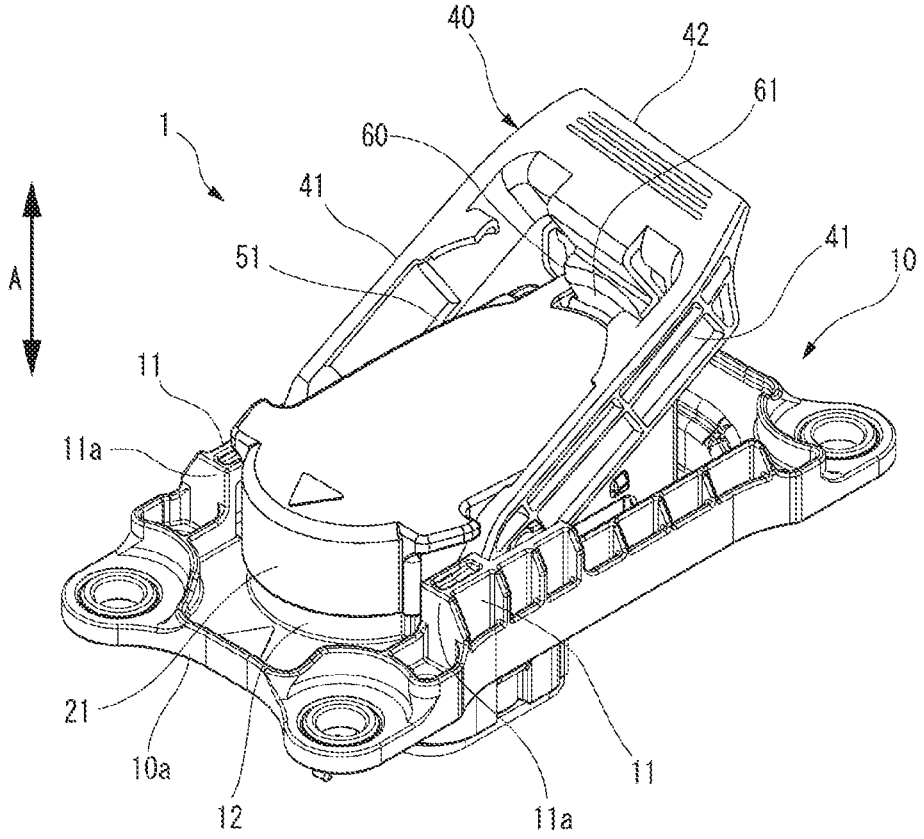
FIG. 4 is a perspective view of the power supply circuit disconnection device in which the first connector housing and the second connector housing are in a temporarily fitted state.

FIG. 1 is a perspective view of a first connector housing and a second connector housing of a power supply circuit disconnection device according to the present embodiment. FIG. 2 is a perspective view of the power supply circuit disconnection device in which the first connector housing and the second connector housing are in an attaching or detaching state. FIG. 3 is a perspective view of the power supply circuit disconnection device in which the first connector housing and the second connector housing are in a finally fitted state. FIG. 4 is a perspective view of the power supply circuit disconnection device in which the first connector housing and the second connector housing are in a temporarily fitted state.

As shown in FIGS. 1 to 4, a power supply circuit disconnection device 1 according to the present embodiment includes a first connector housing 10 and a second connector housing 20. The second connector housing 20 is configured to be fitted to and separated from the first connector housing 10. The second connector housing 20 includes a lever 40. The lever 40 is rotatably provided on the second connector housing 20, and applies, by rotation of the lever 40, fitting force and separation force between the second connector housing 20 and the first connector housing 10. By the rotation of the lever 40, the first connector housing 10 and the second connector housing 20 are moved along an insertion-removal direction A to be fitted to and separated from each other.

The power supply circuit disconnection device 1 is, for example, a so-called service plug configured to disconnect energization between a power supply unit and a load for the purpose of ensuring operation safety in maintenance of an electrical system in a vehicle such as an electric vehicle or a hybrid vehicle. Specifically, energization between the power supply unit and the load is enabled when the second connector housing 20 is fitted to the first connector housing 10, and the energization between the power supply unit and the load is disconnected when the second connector housing 20 is separated from the first connector housing 10.

The first connector housing 10 is formed of an insulating synthetic resin. The first connector housing 10 has a flange portion 10*a* protruding to an outer periphery, and is mounted on a power supply device or the like by fixing the flange portion 10*a* to a case. Further, at one end side of the first connector housing 10, an accommodating portion 19 is formed in the flange portion 10*a*.

The first connector housing 10 includes an accommodation tubular portion 12 having an open upper surface. The accommodation tubular portion 12 is formed into a rectangular shape in a plan view. Further, side wall portions 11 are standing on both side portions of the accommodation tubular portion 12 of the first connector housing, and fulcrum protrusions 11*a* are formed on the side wall portions 11 near the other end of the first connector housing 10.

The second connector housing 20 is formed of an insulating synthetic resin, and includes an outer peripheral tubular portion 21 and a fitting portion 22 on an inner side of the outer peripheral tubular portion 21. The second connector housing 20 is provided with a pair of support shafts 23 protruding from both side surfaces of the outer peripheral tubular portion 21. A pair of main lock protrusions 28 is formed near one end on both side surfaces of the outer peripheral tubular portion 21 of the second connector housing 20. Further, a pair of sub-lock claws 29 is formed at one end of the outer peripheral tubular portion 21 of the second connector housing 20. The sub-lock claws 29 protrude outward from an upper portion of the second connector housing 20.

The fitting portion 22 of the second connector housing 20 is formed in an oval shape in a plan view slightly smaller than an outer shape of the accommodation tubular portion 12 of the first connector housing 10. The second connector housing 20 is fitted from an upper side of the accommodation tubular portion 12 such that the fitting portion 22 is fitted to the accommodation tubular portion 12 of the first connector housing 10. Then, the accommodation tubular portion 12 enters between the fitting portion 22 and the outer peripheral tubular portion 21 by fitting the fitting portion 22 into the accommodation tubular portion 12.

Figure 5A:
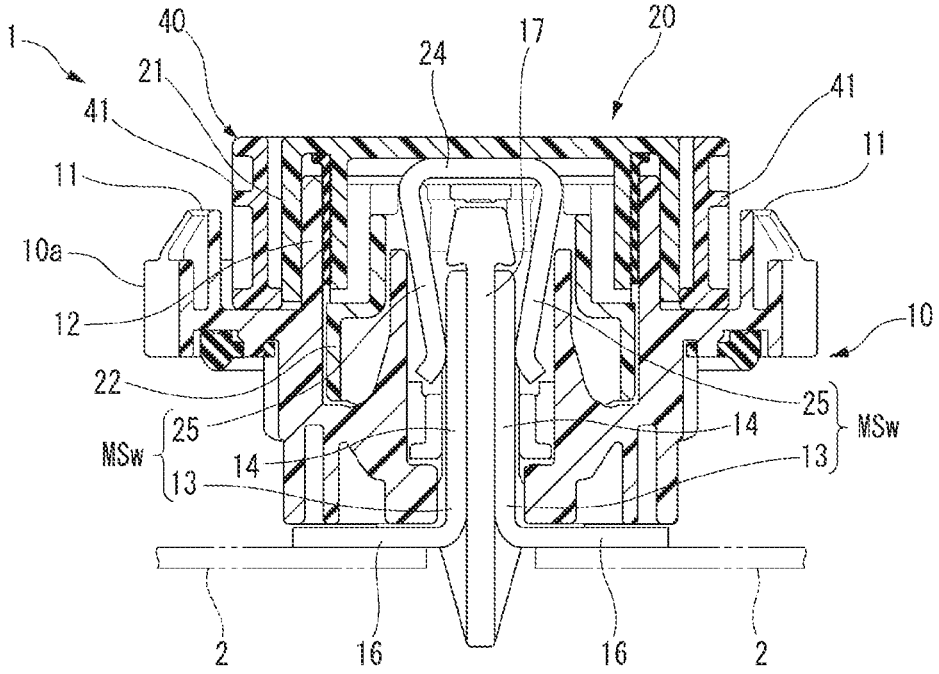
Figure 5B:
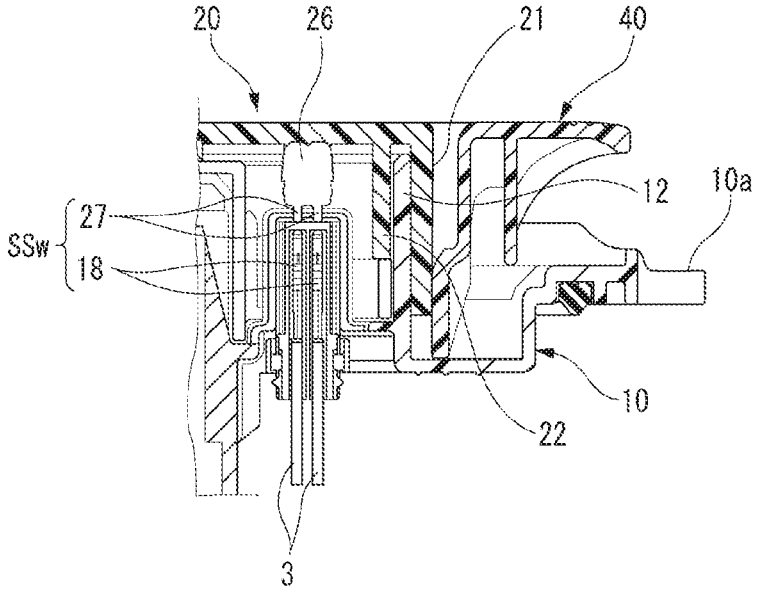

FIGS. 5A and 5B are views showing an internal structure of power supply circuit disconnection device, in which FIG. 5A is a cross-sectional view taken along a width direction of the power supply circuit disconnection device, and FIG. 5B is a partial cross-sectional view taken along a length direction of the power supply circuit disconnection device.

As shown in FIG. 5A, the first connector housing 10 is provided with a pair of main terminals 13 in the accommodation tubular portion 12. The main terminal 13 is configured by a side-view L-shaped bus bar formed of a conductive metal material. In the main terminal 13, one end portion is a male terminal portion 14, and the other end portion extending in a direction orthogonal to the male terminal portion 14 is a connecting portion 16. The male terminal portions 14 of the respective main terminals 13 are disposed so as to sandwich an insulating plate portion 17 formed of a part of the first connector housing 10. The connecting portions 16 of the main terminals 13 are connected to power supply lines 2 from a power supply device or the like.

A main bus bar 24 formed of a conductive metal material is provided inside the second connector housing 20. The main bus bar 24 is formed in a substantially U-shape in the side view having a pair of contact plate portions 25. The pair of male terminal portions 14 of the main terminals 13 of the first connector housing 10 is inserted between the contact plate portions 25 of the main bus bar 24. When the male terminal portions 14 of the main terminals 13 are inserted between the contact plate portions 25 of the main bus bar 24, the power supply lines 2 connected to the main terminals 13 are electrically connected to each other via the main bus bar 24.

As shown in FIG. 5B, the first connector housing 10 is provided with a pair of sub-terminals 18 formed of female terminals inside the accommodation tubular portion 12. The sub-terminals 18 are connected with signal lines 3.

A sub-bus bar 26 formed of a conductive metal material is provided inside the fitting portion 22 of the second connector housing 20. The sub-bus bar 26 includes a pair of male terminal portions 27. The male terminal portions 27 of the sub-bus bar 26 can be connected to the sub-terminals 18 of the first connector housing 10 respectively. When the male terminal portions 27 of the sub-bus bar 26 are connected to the sub-terminals 18, the signal lines 3 connected to the sub-terminals 18 are electrically connected to each other via the sub-bus bar 26.

As described above, the power supply circuit disconnection device 1 includes a main switch unit MSw configured by the main terminal 13 and the contact plate portion 25 of the main bus bar 24, and a sub-switch unit SSw configured by the sub-terminal 18 and the male terminal portion 27 of the sub-bus bar 26. In a power supply device including the power supply circuit disconnection device 1, a power supply circuit is formed when the main switch unit MSw is switched on and the power supply lines 2 are electrically connected to each other, and a signal circuit is formed when the sub-switch unit SSw is switched on and the signal lines 3 are electrically connected to each other. In the power supply device including the power supply circuit disconnection device 1, even if the main switch unit MSw is switched on and the power supply circuit is formed, the power supply circuit is not brought into a connected state unless the sub-switch unit SSw is switched on and the signal circuit is formed. That is, only when both the main switch unit MSw and the sub-switch unit SSw are switched on, the power supply circuit is brought into the connected state.

As shown in FIGS. 1 to 4, the lever 40 is formed of a synthetic resin and includes a pair of arm portions 41 and a connection portion 42. One ends of the arm portions 41 are connected by the connection portion 42, and each of the arm portions 41 includes a shaft receiving hole 44 near the other end. The support shafts 23 of the second connector housing 20 are inserted into the shaft receiving holes 44 of the arm portions 41, so that the lever 40 is rotatably supported relative to the second connector housing 20. The other end of the arm portion 41 of the lever 40 is a pressing portion 46 having a curved surface 45.

The lever 40 rotatably supported by the second connector housing 20 rotates between a separating operation position (position shown in FIGS. 1 and 2) along the insertion-removal direction A and a final fitting operation position (position shown in FIG. 3) along a direction orthogonal to the insertion-removal direction A.

Figure 6A:
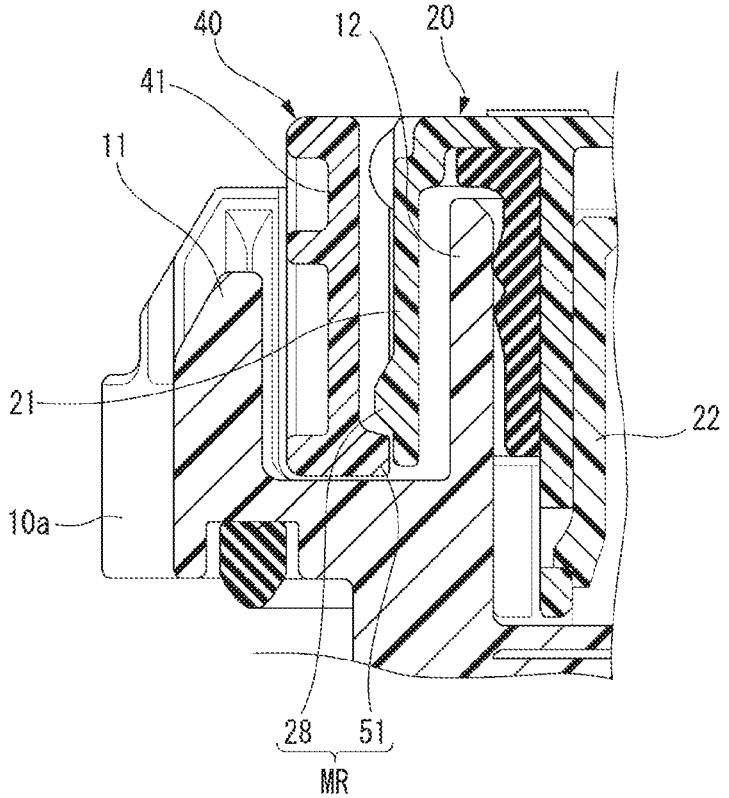
Figure 6B:
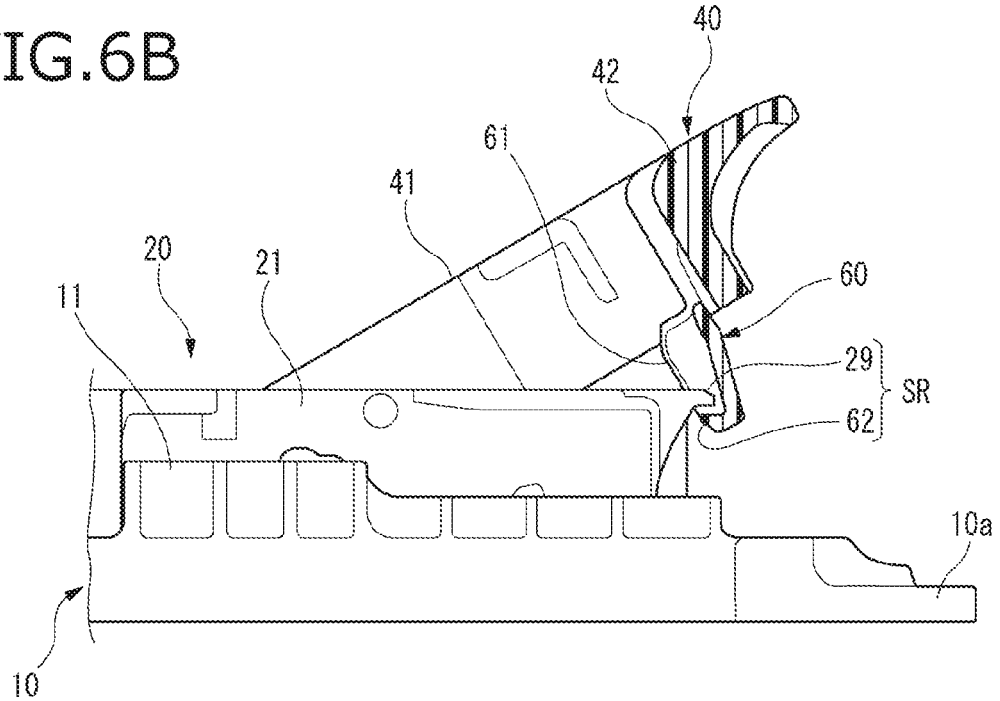

FIGS. 6A and 6B are views showing a lock mechanism of the lever, in which FIG. 6A is a partial cross-sectional view taken along the width direction of the power supply circuit disconnection device in the finally fitted state showing the main lock unit, and FIG. 6B is a side view of the power supply circuit disconnection device in the temporarily fitted state in which the lever is viewed in cross section.

As shown in FIG. 6A, main lock pieces 51 are formed on the second connector housing 20 side in respective arm portions 41 of the lever 40. The main lock pieces 51 are formed along an extending direction of the arm portions 41. The main lock pieces 51 engage with the main lock protrusions 28 of the second connector housing 20 in a state where the lever 40 is disposed at the final fitting operation position. Accordingly, the lever 40 is locked at the final fitting operation position by the main lock pieces 51 engaging with the main lock protrusions 28. Further, the main lock protrusion 28 and the main lock piece 51 configure a main lock unit MR.

As shown in FIG. 6B, a sub-lock plate portion 60 is integrally formed with the connection portion 42 in the lever 40. The sub-lock plate portion 60 includes a lock releasing portion 61 and a pair of engaging claws 62. The sub-lock plate portion 60 is provided to protrude forward in a rotation direction from the separating operation position to the final fitting operation position of the lever 40. The engaging claws 62 are formed on both sides of the lock releasing portion 61 and are provided on a side opposite to the connection portion 42. When the lever 40 at the final fitting operation position is rotated toward the separating operation position, the engaging claws 62 of the sub-lock plate portion 60 engage with the sub-lock claws 29 formed on the second connector housing 20 in the middle of the rotation. Accordingly, the lever 40, which is rotated from the final fitting operation position toward the separating operation position, is temporarily locked in the middle of the rotation. A position where the lever 40 is locked in the middle of the rotation is a temporary fitting operation position (position shown in FIG. 4). The sub-lock claw 29 and engaging claw 62 configure a sub-lock unit SR. The sub-lock plate portion 60 is elastically deformed by pressing the lock releasing portion 61, the engaging claws 62 are disengaged from the sub-lock claws 29 and a engagement state is released, so that the lock of the lever 40 at the temporary fitting operation position is released.

Figure 7:
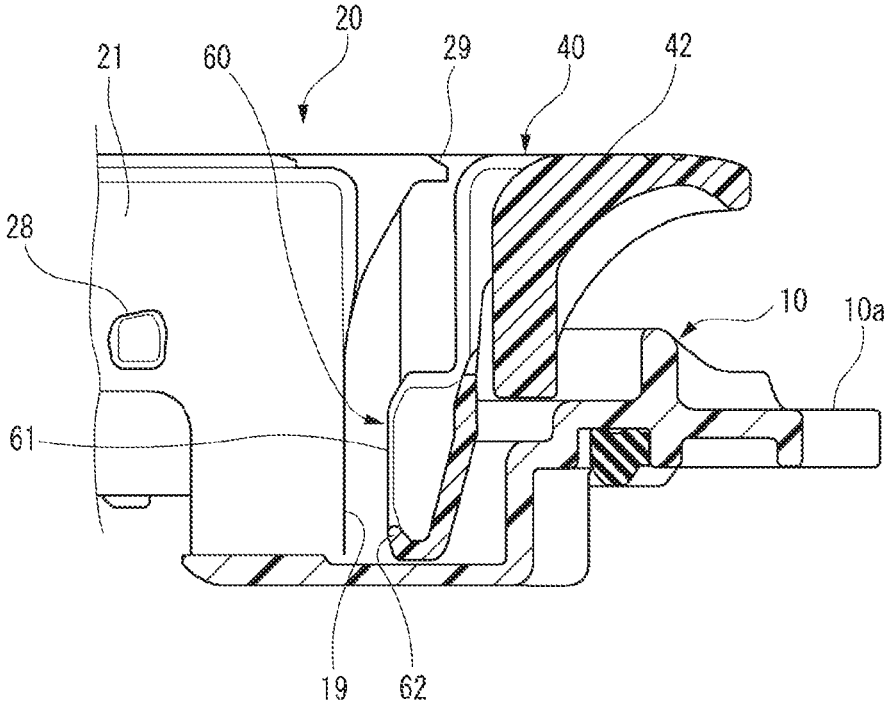
FIG. 7 is a partial cross-sectional view taken along the length direction of the power supply circuit disconnection device in the finally fitted state.

FIG. 7 is a partial cross-sectional view taken along the length direction of the power supply circuit disconnection device in the finally fitted state.

As shown in FIG. 7, in a state where the lever 40 is disposed at the final fitting operation position, the sub-lock plate portion 60 having the lock releasing portion 61 and the engaging claws 62 of the sub-lock unit SR is accommodated in an accommodating portion 19 formed in the flange portion 10*a* of the first connector housing 10. Accordingly, in the finally fitted state, the sub-lock unit SR is in a state where the lock releasing portion 61 configured to be pressed so as to release the lock enters the inside of the power supply circuit disconnection device 1 and can not be in contact.

Next, in the power supply circuit disconnection device 1 including the main lock unit MR and the sub-lock unit SR, cases where the second connector housing 20 is fitted to and separated from the first connector housing 10 will be described.

(Fitting Case)

In order to fit the second connector housing 20 to the first connector housing 10, the second connector housing 20 in which the lever 40 is disposed at the separating operation position is brought close to the first connector housing 10. Then, the fitting portion 22 of the second connector housing 20 is fitted into the accommodation tubular portion 12 of the first connector housing 10 in the attaching or detaching state (see FIG. 2).

In the attaching or detaching state, the lever 40 at the separating operation position is rotated toward the final fitting operation position. Then, the curved surface 45 of the pressing portion 46 of the lever 40 abuts against the fulcrum protrusion 11*a* formed on the side wall portion 11 of the first connector housing 10 and slides on the curved surface 45. Accordingly, fitting force is applied between the first connector housing 10 and the second connector housing 20, and the second connector housing 20 is pulled into the first connector housing 10.

When the lever 40 reaches the final fitting operation position, the first connector housing 10 and the second connector housing 20 are finally fitted with each other in the finally fitted state (see FIG. 3). In the finally fitted state, the main lock pieces 51 of the lever 40 engage with the main lock protrusions 28 of the second connector housing 20, and careless rotation of the lever 40 is restricted. That is, the main lock unit MR maintains the finally fitted state in which the first connector housing 10 and the second connector housing 20 are finally fitted to each other.

In the finally fitted state, the contact plate portions 25 of the main bus bar 24 are connected to the male terminal portions 14 of the main terminals 13. That is, the main switch unit MSw is switched on, and the power supply lines 2 connected to the main terminals 13 are electrically connected to each other via the main bus bar 24. Further, the male terminal portions 27 of the sub-bus bar 26 are connected to the sub-terminals 18. That is, the sub-switch unit SSw is switched on, and the signal lines 3 connected to the sub-terminals 18 are electrically connected to each other via the sub-bus bar 26.

(Separating Case)

In order to separate the second connector housing 20 from the first connector housing 10, the lever 40 disposed at the final fitting operation position is grasped and pulled up. Then, the main lock piece 51 of the lever 40 is disengaged from the main lock protrusions 28 of the second connector housing 20, the lock of the lever 40 is released by the main lock unit MR configured to maintain the finally fitted state, and the lever 40 is rotated toward the separating operation position.

When the lever 40 is rotated toward the separating operation position, the pressing portion 46 of the lever 40 abuts and slides on a surface of the flange portion 10*a* of the first connector housing 10 as the lever 40 rotates. Accordingly, separation force is applied between the first connector housing 10 and the second connector housing 20. Therefore, the second connector housing 20 in the finally fitted state to the first connector housing 10 is pulled away from the first connector housing 10 and displaced toward a separating direction.

When the rotating lever 40 reaches the temporary fitting operation position, the engaging claws 62 of the sub-lock plate portion 60 engage with the sub-lock claws 29 of the second connector housing 20 to function as the sub-lock unit SR, so that the lever 40 is locked at the temporary fitting operation position and the rotation is restricted. Accordingly, the first connector housing 10 and the second connector housing 20 are in the temporarily fitted state (see FIG. 4).

In the temporarily fitted state, the male terminal portion 27 of the sub-bus bar 26 is pulled out from the sub-terminal 18. That is, the sub-switch unit SSw is switched off, and the electrical connection between the signal lines 3 is released. In the temporarily fitted state, the contact plate portion 25 of the main bus bar 24 is maintained in the state of being connected to the male terminal portion 14 of the main terminal 13. That is, the main switch unit MSw is kept to be switched on, and the electrical connection between the power supply lines 2 is maintained.

From the temporarily fitted state, the lock releasing portion 61 of the sub-lock plate portion 60 of the sub-lock unit SR is pressed. Then, the sub-lock plate portion 60 is elastically deformed by pressing the lock releasing portion 61, the engaging claws 62 are disengaged from the sub-lock claws 29 and the engagement state is released, so that the lock of the lever 40 by the sub-lock unit SR at the temporary fitting operation position is released.

Once the lock by the sub-lock unit SR is released, the rotatable lever 40 is rotated again toward the separating operation position. Then, the separation force is applied between the first connector housing 10 and the second connector housing 20 again by the rotation of the lever 40, and the second connector housing 20 is pulled away from the first connector housing 10, so that the first connector housing 10 and the second connector housing 20 are in a separable state (see FIG. 2).

As described above, when the second connector housing 20 is displaced from the temporarily fitted state with the first connector housing 10 toward the separating direction and becomes the separable state, the contact plate portion 25 of the main bus bar 24 is disengaged from the male terminal portion 14 of the main terminal 13. Accordingly, the main switch units MSw are switched off, and the electrical connection between the power supply lines 2 is released.

Then, when the second connector housing 20 is pulled away from the first connector housing 10, the fitting portion 22 of the second connector housing 20 is pulled out from the accommodation tubular portion 12 of the first connector housing 10, and the second connector housing 20 is separated from the first connector housing 10 (see FIG. 1).

As described above, in the power supply circuit disconnection device 1 described above, the main switch unit MSw is switched on in the finally fitted state locked by the main lock unit MR as well as in the temporarily fitted state locked by the sub-lock unit SR; the sub-switch unit SSw is switched on in the finally fitted state locked by the main lock unit MR, and is switched off in the temporarily fitted state locked by the sub-lock unit SR. Therefore, in the power supply circuit disconnection device 1, after the sub-switch unit SSw is switched off and the electrical connection between the signal lines 3 is released, if the lock by the sub-lock unit SR is not released, the main switch unit MSw is switched off, and the electrical connection between the power supply lines 2 cannot be released. Accordingly, the occurrence of arcs, sparks or the like resulting from remaining current generated by releasing the connection between the power supply lines 2 immediately after releasing the connection between the signal lines 3 can be prevented.

However, if the lock releasing portion 61 configured to release the lock by the sub-lock unit SR is usually exposed to the outside, when the lever 40 at the final fitting operation position is rotated toward the separating operation position, the lever 40 may be rotated while operating the lock releasing portion 61 exposed to the outside. In this case, the lever 40 is not restricted in rotation by the sub-lock unit SR at the temporary fitting operation position and is rotated from the final fitting operation position to the separating operation position, which may cause the first connector housing 10 and the second connector housing 20 in the finally fitted state are suddenly brought into the separable state. For this reason, a sufficient time lag between on and off of the main switch unit MSw and the sub-switch unit SSw is not ensured, and the occurrence of arcs, sparks or the like resulting from remaining current may not be sufficiently prevented.

However, according to the power supply circuit disconnection device 1 of the present embodiment, the lock releasing portion 61 configured to release the lock by the sub-lock unit SR is covered by the first connector housing (especially, by the accommodating portion 19) and not exposed to the outside in the finally fitted state. Therefore, the lever 40 in the final fitting operation position can be rotated without operating the lock releasing portion 61, so that the rotation of the lever 40 can be reliably restricted at the temporary fitting operation position by the sub-lock unit SR. Accordingly, the time lag between on and off of the main switch unit MSw and the sub-switch unit SSw is reliably ensured, and the occurrence of sparks, arcs or the like resulting from an remaining current after the sub-switch unit SSw is switched off can be favorably prevented.

In the power supply circuit disconnection device 1 according to the present embodiment, the lock releasing portion 61 can be easily accommodated in the accommodating portion 19 provided in the first connector housing 10 by the lever 40 being rotated to dispose at the final fitting operation position. Further, since the lock releasing portion 61 is accommodated in the accommodating portion 19, the contact with the lock releasing portion 61 in the finally fitted state can be further prevented reliably, and the time lag between on and off of the main switch unit MSw and the sub-switch unit SSw is further ensured reliably.

Further, according to the power supply circuit disconnection device 1 of the present embodiment, the lock releasing portion 61 is disposed at a position opposite and close to a side surface of the second connector housing 20 by the lever 40 being disposed at the final fitting operation position, so that the contact with the lock releasing portion 61 in the finally fitted state can be further prevented reliably. Further, the lock releasing portion 61 is disposed on an upper surface side of the second connector housing 20 by the lever 40 being disposed at the temporary fitting operation position, so that the lock releasing portion 61 can be pressed in the temporarily fitted state to separate the engaging claws 62 from the sub-lock claws 29 and release the lock easily.

The invention is not limited to the above embodiment, and may be appropriately modified, improved or the like. In addition, materials, shapes, dimensions, numerals, disposition locations or the like of constituent elements in the above-described embodiment are optional and not limited as long as the object of the present invention can be achieved.

For example, the structure may be configured such that a cam groove is provided on the first connector housing 10 side, and a cam pin configured to engage with the cam groove is formed on the lever 40, so that when the lever 40 is rotated, the cam pin moves along the cam groove to apply the fitting force and the separation force between the first connector housing 10 and the second connector housing 20.

Here, characteristics of the embodiment of the power supply circuit disconnection device according to the present invention described above are summarized briefly in the following [1] to [3], respectively.

[1] A power supply circuit disconnection device including:

a first connector housing (10);

a second connector housing (20) configured to be fitted to and separated from the first connector housing (10);

a lever (40) rotatably supported on the second connector housing (20) and configured to, by being rotated between a separating operation position and a final fitting operation position, bring the first connector housing (10) and the second connector housing (20) into a separable state of being separable from each other and a finally fitted state of being completely fitted with each other;

a sub-lock unit (SR) configured to lock the lever (40) to the second connector housing (20) in a temporarily fitted state in which the lever (40) is disposed at a temporary fitting operation position between the final fitting operation position and the separating operation position and a part of the second connector housing (20) is fitted to the first connector housing (10);

a main switch unit (MSw) configured to be switched on in the finally fitted state and the temporarily fitted state, and switched off in the separable state;

a sub-switch unit (SSw) configured to be switched on in the finally fitted state, and switched off in the temporarily fitted state and the separable state; and a lock releasing portion (61) provided on the lever (40) and configured to release lock of the lever (40) by the sub-lock unit (SR), wherein the lock releasing portion (61) is covered and not exposed to outside in the finally fitted state.

[2] The power supply circuit disconnection device according to [1], wherein the lock releasing portion (61) is provided on a front side of the lever in a rotation direction toward the final fitting operation position of the lever (40), and wherein the first connector housing (10) has an accommodating portion (19) in which the lock releasing portion (61) is accommodated when the lever (40) is disposed at the final fitting operation position.

[3] The power supply circuit disconnection device according to [1] or [2], wherein the lever (40) includes a pair of arm portions (41) one ends of which are rotatably supported on side surfaces of the second connector housing (20), and a connection portion (42) which connects the other ends of the pair of arm portions (41);

wherein the sub-lock unit (SR) includes a sub-lock claw (29) provided on the second connector housing (20), and an engaging claw (62) provided on the connection portion (42) configured to engage with the sub-lock claw (29) at the temporary fitting operation position, and configured to be separated from the sub-lock claw (29) by pressing the lock releasing portion (61); and wherein the lock releasing portion (61) is:

provided on a second connector housing (20) side on the connection portion (42), disposed at a position opposite and close to another side surface of the second connector housing (20) when the lever (40) is disposed at the final fitting operation position, and disposed on an upper surface side of the second connector housing (20) when the lever (40) is disposed at the temporary fitting operation position.

What is claimed is:

1. A power supply circuit disconnection device comprising:

a first connector housing;

a second connector housing configured to be fitted to and separated from the first connector housing;

a lever rotatably supported on the second connector housing and configured to, by being rotated between a separating operation position and a final fitting operation position, bring the first connector housing and the second connector housing into a separable state of being separable from each other and a finally fitted state of being completely fitted with each other;

a sub-lock unit configured to lock the lever to the second connector housing in a temporarily fitted state in which the lever is disposed at a temporary fitting operation position between the final fitting operation position and the separating operation position and a part of the second connector housing is fitted to the first connector housing;

a main switch unit configured to be switched on in the finally fitted state and the temporarily fitted state, and switched off in the separable state;

a sub-switch unit configured to be switched on in the finally fitted state, and switched off in the temporarily fitted state and the separable state; and a lock releasing portion provided on the lever and configured to release lock of the lever by the sub-lock unit, wherein the lock releasing portion is covered and not exposed to outside in the finally fitted state.

2. The power supply circuit disconnection device according to claim 1, wherein the lock releasing portion is provided on a front side of the lever in a rotation direction toward the final fitting operation position of the lever, and wherein the first connector housing has an accommodating portion in which the lock releasing portion is accommodated when the lever is disposed at the final fitting operation position.

3. The power supply circuit disconnection device according to claim 1, wherein the lever includes a pair of arm portions one ends of which are rotatably supported on side surfaces of the second connector housing, and a connection portion which connects the other ends of the pair of arm portions;

wherein the sub-lock unit includes a sub-lock claw provided on the second connector housing, and an engaging claw provided on the connection portion configured to engage with the sub-lock claw at the temporary fitting operation position and configured to be separated from the sub-lock claw by pressing the lock releasing portion; and wherein the lock releasing portion is:

provided on a second connector housing side on the connection portion, disposed at a position opposite and close to another side surface of the second connector housing when the lever is disposed at the final fitting operation position, and disposed on an upper surface side of the second connector housing when the lever is disposed at the temporary fitting operation position.

4. The power supply circuit disconnection device according to claim 1, further comprising:

a main lock unit configured to lock the lever disposed at the final fitting operation position to the second connector housing.

* * * * *